United States Patent [19]

Niemi

[11] Patent Number: 4,546,926

[45] Date of Patent: Oct. 15, 1985

[54] PRESSURE-CHAMBER GRINDER

[76] Inventor: Jouko Niemi, SF-33960 Pirkkala 6, Finland

[21] Appl. No.: 518,800

[22] PCT Filed: Nov. 17, 1982

[86] PCT No.: PCT/FI82/00057

§ 371 Date: Jun. 21, 1983

§ 102(e) Date: Jun. 21, 1983

[87] PCT Pub. No.: WO83/01915

PCT Pub. Date: Jun. 9, 1983

[30] Foreign Application Priority Data

Nov. 27, 1981 [FI] Finland ..... 813812

[51] Int. Cl.[4] ..... B02C 19/06; B02C 23/12

[52] U.S. Cl. ..... 241/39; 241/48; 241/52; 241/80; 241/97; 241/152 R

[58] Field of Search ..... 241/5, 39, 48, 52, 57, 241/61, 62, 74, 152 R, 79, 79.1, 80, 97

[56] References Cited

U.S. PATENT DOCUMENTS

| | | | |
|---|---|---|---|
| 2,846,151 | 8/1958 | Wehn et al. . | |
| 3,186,648 | 6/1965 | Mandle et al. . | |
| 3,643,875 | 2/1972 | Dille et al. | 241/5 |
| 3,675,858 | 7/1972 | Stephanoff | 241/5 |
| 4,056,233 | 11/1977 | Fay | 241/39 |
| 4,304,360 | 12/1981 | Luhr et al. | 241/5 |

FOREIGN PATENT DOCUMENTS

| | | |
|---|---|---|
| 1952964 | 10/1969 | Fed. Rep. of Germany . |
| 1329941 | 9/1973 | United Kingdom . |
| 1422105 | 1/1976 | United Kingdom . |

*Primary Examiner*—Howard N. Goldberg
*Assistant Examiner*—Timothy V. Eley
*Attorney, Agent, or Firm*—McGlew and Tuttle

[57] ABSTRACT

A pressure-chamber grinder comprises a grinder chamber of substantially circular section, which chamber is provided with a feed opening for the material to be ground, fed as a gas-tight plug, and the opposite end of which chamber is provided with an outlet opening for the ground material. Tangentially directed grinding-gas nozzles are fitted and are uniformly spaced around the entire circumference of the mantle face of the grinder chamber, or at least of part of same. The object of the present invention is to force the entire material flow to rush into every grinding zone. This has been achieved so that the grinder chamber is, by means of a partition wall, divided into a pre-grinding chamber and a grinding chamber proper, the chambers being interconnected by means of at least two Laval nozzles passing through the partition wall and forming an angle with each other, whereat the material-gas jets rushing through these nozzles at a supersonic speed collide against each other at the outlet side of the Laval nozzles, thus forming there a grinding zone, to which zone the coarse fraction separated in a classifier connected to the outlet opening of the grinding chamber is returned.

10 Claims, 2 Drawing Figures

PRESSURE-CHAMBER GRINDER

FIELD AND SUMMARY OF THE INVENTION

The present invention is concerned with a pressure-chamber grinder in which the material to be ground, such as talc, bolus, titanium oxide, or soot, is ground to ultra-fine-grain particles by means of grinding gas. The grinding comprises a grinder chamber of substantially circular section, and the chamber is provided with a feed opening for the material to be ground, fed as a gas-tight plug, as well as with tangentially directed nozzles for the grinding gas, fitted as uniformly spaced on the mantle face or at least on a part of same. At the opposite end of the grinder, there is an outlet opening for the ground material, a classifier being connected to the said opening, from which classifier the coarse fraction can be returned into the grinder. As the grinding gas, compressed air or water vapour, is used, favourably superheated water vapour.

In an attempt to improve the energy economy of jet grinders, the first operation has been to replace the ejector feeder of a conventional grinder by a so-called plug feeder, whereby energy economies of up to 10 to 15 percent have been achieved.

In practice, it has, however, been noticed that a grinder constructed in view of the ejector feeder does not operate fully satisfactorily when a plug feeder is used. This is why, for example, a jet grinder has been developed whose grinder chamber has the shape of an oblong box, through which the material to be ground passes, the grinding-gas nozzles being arranged along two opposite walls of the grinder chamber and directed so that the grinding-gas jet coming from each nozzle acts upon the material to be ground in a way for both grinding and changing the direction of flow. The efficiency of the apparatus is relatively good, because the material is subjected to the grinding effect at each nozzle. However, there is the drawback that part of the material to be ground can flow past the nozzle without being at all subjected to the grinding effect.

The object of the present invention is also to eliminate this drawback by developing an apparatus in which the entire material flow is forced to pass through several grinding zones without being able to by-pass them. The pressure-chamber grinder in accordance with the invention is characterized in that the grinder chamber is, by means of a partition wall, divided into a pre-grinding chamber and a grinding chamber proper, the chambers being interconnected by means of at least two Laval nozzles passing through the partition wall and, in a way in itself known, forming an angle with each other, so that the material-gas jets rushing through the nozzles at a supersonic speed collide against each other in the grinding zone formed at the outlet side of the Laval nozzles and that the coarse fraction coming from the classifier is arranged for coming back straight into this grinding zone.

BRIEF DESCRIPTION OF THE DRAWINGS

The invention will be described below in more detail with reference to the attached drawing, wherein.

DESCRIPTION OF THE PREFERRED EMBODIMENT

Figure 1:
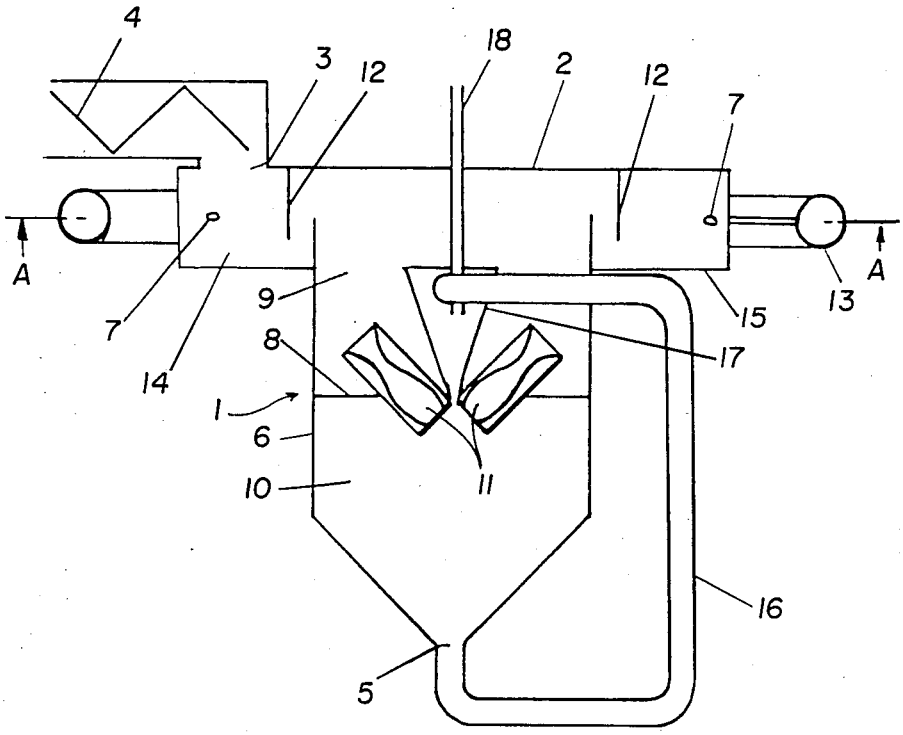
FIG. 1 shows an example of an apparatus in accordance with the invention as a side view.
Figure 2:
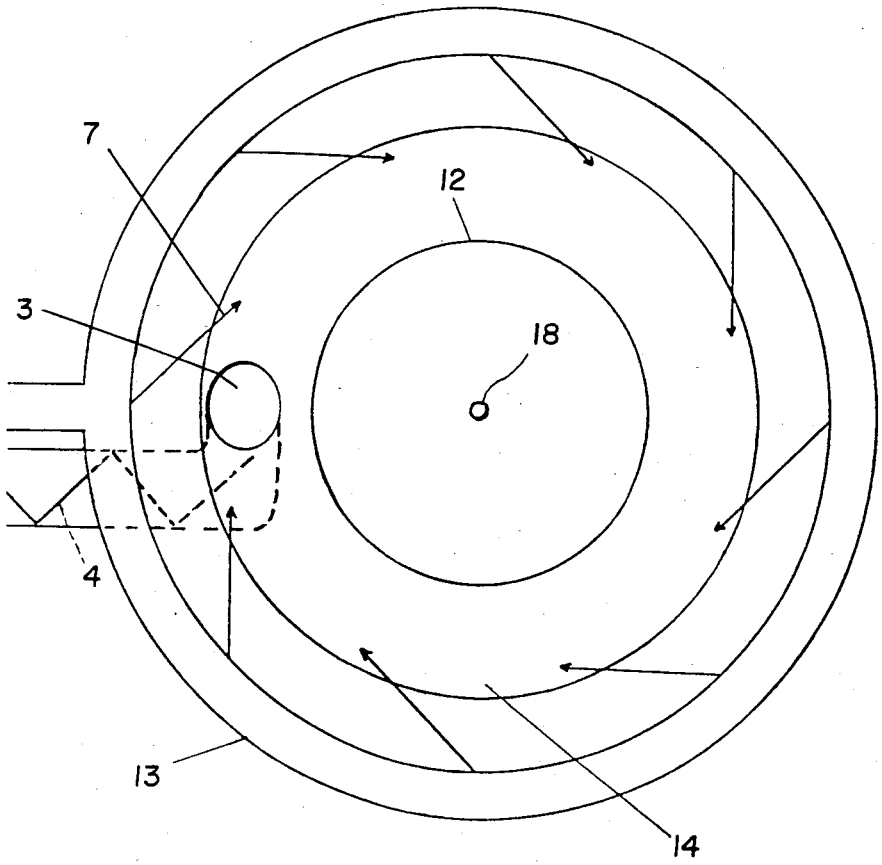
FIG. 2 shows a section along line A—A in FIG. 1.

The pressure-chamber grinder in accordance with the present invention comprises a grinder chamber 1 of substantially circular section, which is provided with a feed opening 3 for the material to be ground, fed as a gas-tight plug, and whose opposite end is provided with an outlet opening 5 for the material which has been ground. Tangentially directed grinding-gas nozzles 7 are arranged to be uniformly spaced around the entire circumference of the mantle face over at least a part of the mantle face 6 of the grinder chamber 1. The oblong grinder chamber 1 is, divided into a main pre-grinding chamber 9 and a grinding chamber 10 proper by a substantially transverse partition wall 8. These chambers are interconnected by means of at least two Laval (or laval) nozzles 11 forming an angle with each other. The material-gas jets rushing through the nozzles at a supersonic speed intersect each other in the grinding chamber 10 placed immediately at the outlet side of the Laval nozzles 11, at which point a zone of collision of the material particles to be ground is formed. The coarse fraction coming from the classifier 17 connected to the outlet opening 5 of the grinding chamber 10 is returned to this zone.

In view of efficient operation of the apparatus, it is essential that the collision zone is formed immediately in the proximity of the outlet side of the Laval nozzles 11 in order that the speed of the gas flows should not have time to be lowered. The location of the collision point and the extent of the collision zone can be affected by means of the angle between the Laval nozzles 11, which angle may vary within the limits of about 60° to 180°, whereat angles within the range of about 90° to 120° have proven to be most advantageous.

The feed opening 3 may be located at any place near one end of the grinder chamber 1, preferably close to the mantle face 6, so that the material to be ground, which is fed into the grinder chamber by means of the plug feeder at 4, is immediately subjected to the action of the grinding-gas flows coming from the nozzles 7.

One should aim at the circumstance that the inlet angle between the material-gas jets discharged through the Laval nozzles 11 is such that a favourable material circulation is produced in the grinder.

If necessary, it is possible to connect two or more grinder units in series. In such a case, a requirement is that a grinding gas of sufficiently high pressure is available in order that the speed of the material-gas jet passing through each Laval nozzle 11 should become supersonic.

At least a part of the mantle face 6 of the grinding chamber 10 provided with the outlet opening 5 is conical so that the cross-sectional area of the grinding chamber 10 becomes smaller towards the outlet opening 5, whereat the speed of the material-gas flow rushing out of the grinder becomes higher.

In order to intensify the material-gas flow taking place in the pre-grinding chamber 9, it is advantageous to shape each partition wall 8, in the direction of inlet of the flow, either conical or convex, whereat the feed openings of the Laval nozzles 11 placed in the partition wall 8 may be placed entirely at the face of the partition wall 8. When the partition walls 8 are shaped in this way, unnecessary recesses and projecting portions are avoided at the same time, which recesses and projections would be subject to intensive wear.

According to a preferred embodiment, the end of the grinder chamber 1 placed next to the feed opening 3 is provided with a pre-grinding portion 14, whose cross-sectional area is larger than that of the rest of the grinder chamber 1 and whose mantle face is provided with tangentially directed grinding-gas nozzles 7. The feed opening 3 of the grinder is placed at the proximity of the mantle face of the pre-grinding portion 14. In the solution shown in FIG. 1, the feed opening 3, to which the feeder pipe coming from the plug feeder and provided with a screw conveyor 4 is connected, is located in the end wall 2. It is recommended that the material to be ground is, before it is fed into the pre-grinding portion 14, by means of a separate grinding-gas jet, accelerated to the same speed as the speed of the material-gas flow circulating in the pre-grinding portion 14.

To each end wall 2, 15 of the pre-grinding portion 14, at least one partition wall 6, 12 is attached which is parallel to the circumference and which partition walls are concentric and have a height of at least half the overall height of the pre-grinding portion 14 so that they slightly overlaps each other. The function of these partition walls 6, 12 is to operate as some sort of obstacle for the material flow fluidized in the pre-grinding portion 14, whereat the pregrinding and classification taking place in this portion are intensified.

In order to simplify the entire grinder apparatus, it is advantageously possible to place the classifier 17 in the pre-grinding chamber 9 so that its outlet end for the coarse fraction passes through the partition wall 8 at the centre point of this wall and extends to the zone of collision of the material-gas jets rushing through the Laval nozzles 11 so that the coarse fraction coming out of the classifier 17 is immediately subjected to a new grinding action. The classifier 17, which is preferably of the cyclone type, is, over connecting pipe 16, connected to the outlet opening 5 of the grinding chamber 10, from which the ground material-gas flow is passed into the classifier 17 tangentially. In the classifier 17, the coarse fraction is separated from the rest of the material flow by means of the centrifugal force and returned into the collision or grinding zone. The fine fraction is passed through an outlet pipe 18 provided at the other end of the classifier 17 possibly into a subsequent pressure-chamber grinder, operating at a lower pressure, or straight into a product tank.

By providing the tangentially directed grinding-gas nozzles 7 only at the mantle face of the pre-grinding portion 14, the nozzles 7 being connected to the grinding-gas distributor beam or conduit 13 surrounding the pre-grinding portion 14, an advantageously operating grinder is obtained into which high-pressure grinding gas is fed exclusively through the nozzles 7.

The grinder chamber 1 may be positioned either vertically or horizontally, depending on the type of classifier 17 used and on the location of the classifier.

In connection with a pressure-chamber grinder in accordance with FIG. 1, superheated water vapour at a pressure of at least 7 bars is used as the grinding gas, the vapour being fed into the pregrinding portion 14 through the nozzles 7 and a positive pressure of at least 3 bars being maintained in the pre-grinding portion 14 by means of the vapour. In the subsequent grinding chamber 10, into which the material-gas flow rushes at a supersonic speed through the Laval nozzles 11, appropriately a positive pressure of about 0.05 to 0.1 bar is maintained, the material-gas mixture being passed from the chamber 10 to the classifier 17.

It is evident that the various details of the pressure-chamber grinder may be designed in many different ways within the scope of the invention.

What is claimed is:

1. A pressure chamber grinder for grinding material into ultrafine grain particles by means of a grinding gas, comprising:

a housing defining a space and having a mantle face extending around said space;

a partition wall connected in said housing dividing said housing space into a pre-grinding chamber and a main grinding chamber and extending substantially transversely to said mantle face;

said housing including a portion defining a pregrinding portion having a cross-sectional area larger than said pre-grinding chamber, said pre-grinding portion being connected to said pre-grinding chamber;

material feed means connected to said housing and communicating with said pre-grinding portion for feeding a gas-tight plug of material to said pre-grinding portion;

a plurality of tangentially directed nozzles, uniformly spaced around said mantle face and connected to said housing for supplying grinding gas under pressure to said pre-grinding portion of said housing;

a pair of concentric walls connected to said housing for separating said pre-grinding portion from said pre-grinding chamber, each of said concentric walls extending axially by at least one-half an overall height of said pre-grinding portion;

said housing having an outlet communicating with said main grinding chamber for discharging at least partially ground material from said main grinding chamber;

at least two laval nozzles extending through said partition wall extending toward a centerline of said main grinding chamber and forming an angle with each other, said laval nozzles communicating with said pre-grinding chamber and with said main grinding chamber and structured to pass material with grinding gas from said pre-grinding chamber to said main grinding chamber at supersonic speed, said main grinding chamber including a grinding zone adjacent an outlet of each of said two laval nozzles at which material and grinding gas collide at supersonic speed, said grinding zone spaced from said outlet; and a classifier connected to said housing outlet and having a classifier outlet for discharging material and grinding gas into said grinding zone, said classifier separating a coarse fraction from a fine fraction of material which has been ground in said pre and main grinding chambers, supplying said coarse fraction to said grinding zone and supplying said fine fraction out of said housing.

2. A grinder according to claim 1, wherein said angle formed between said laval nozzles is from 60° to 180°.

3. A grinder according to claim 2, wherein said angle between said laval nozzles is from 90° to 120°.

4. A grinder according to claim 1, wherein said mantle face around a portion of said housing space defining said main grinding chamber has a conical portion which reduces in diameter and terminates at said housing outlet.

5. A grinder according to claim 1, wherein said pre-grinding chamber and main grinding chamber have circular cross-sections, said pre-grinding portion having a circular cross-section disposed radially outwardly of said pre-grinding chamber.

6. A grinder according to claim 1, wherein said housing has a first cylindrical portion defining at least a portion of said pre-grinding and main grinding chambers, one of said concentric walls extending axially above said cylindrical portion of said housing, the other of said concentric walls being disposed radially outwardly of said cylindrical portion and extending in an opposite direction in said pre-grinding portion.

7. A grinder according to claim 1, wherein said classifier is disposed in said pre-grinding chamber, a connecting pipe connected between said housing outlet and said classifier for supplying material with grinding gas from said housing outlet into said classifier tangentially, and an outlet pipe connected near a center of said classifier and extending out of said housing for supplying the fine fraction of material out of said classifier.

8. A grinder according to claim 7, wherein said pre and main grinding chambers are circular, said classifier disposed near a center of said pre-grinding chamber.

9. A grinder according to claim 8, including a distributor conduit surrounding said pre-grinding portion, said plurality of tangentially directed nozzles connected between said distributor conduit and said pre-grinding portion.

10. A grinder according to claim 1, wherein a major axis of said housing extending through said pre- and main grinding portions extends one of horizontally and vertically.

* * * * *